US007644527B2

(12) United States Patent
Clark et al.

(10) Patent No.: US 7,644,527 B2
(45) Date of Patent: Jan. 12, 2010

(54) MULTI-PANEL BILLBOARD ACCESSORY

(75) Inventors: Jeremy A. Clark, Minneapolis, MN (US); Michael A. Whittier, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 95 days.

(21) Appl. No.: 11/777,765

(22) Filed: Jul. 13, 2007

(65) Prior Publication Data

US 2009/0013572 A1 Jan. 15, 2009

(51) Int. Cl.
*G09F 15/00* (2006.01)

(52) U.S. Cl. ..... 40/610; 40/124.13; 40/539; 211/206

(58) Field of Classification Search ..... 40/610, 40/124.16, 124.15, 124.13, 124.09, 539, 40/124.14; 211/190, 206; 160/84.08
See application file for complete search history.

(56) References Cited

U.S. PATENT DOCUMENTS

| | | | | |
|---|---|---|---|---|
| 1,736,726 | A * | 11/1929 | Young | 206/768 |
| 2,896,789 | A | 7/1959 | Sans et al. | |
| 3,059,362 | A * | 10/1962 | Scherotto | 40/610 |
| 3,149,727 | A | 9/1964 | Magers | |
| 3,397,771 | A * | 8/1968 | Fogle | 206/750 |
| 4,035,941 | A | 7/1977 | Deffner | |
| 4,322,007 | A | 3/1982 | Feibelman | |
| 4,655,354 | A | 4/1987 | Cohen | |
| 4,685,573 | A | 8/1987 | Ovitz, III | |
| 4,932,539 | A | 6/1990 | Abinanti | |
| D318,194 | S | 7/1991 | Terrell et al. | |
| D319,934 | S | 9/1991 | Terrell et al. | |
| D322,188 | S | 12/1991 | Leis et al. | |
| D327,788 | S | 7/1992 | Allen | |
| 5,240,127 | A | 8/1993 | Levin et al. | |
| D362,981 | S | 10/1995 | Lechleiter et al. | |
| 5,465,852 | A | 11/1995 | Koks et al. | |
| D394,360 | S | 5/1998 | Geier et al. | |
| 6,029,833 | A | 2/2000 | Yeh | |
| 6,062,402 | A | 5/2000 | Ford | |
| D435,743 | S | 1/2001 | Glauth et al. | |
| D450,948 | S | 11/2001 | Stafford et al. | |
| 6,364,137 | B1 | 4/2002 | Glauth et al. | |
| D457,751 | S | 5/2002 | Stafford et al. | |
| D468,936 | S | 1/2003 | Miranda | |
| D474,350 | S | 5/2003 | Sardis | |

(Continued)

OTHER PUBLICATIONS

Clark, Jeremy A. et al., "Display Fixture Accessories", U.S. Appl. No. 11/627,262, filed Jan. 25, 2007, 45 pgs.

*Primary Examiner*—Lesley Morris
*Assistant Examiner*—Kristina Staley
(74) *Attorney, Agent, or Firm*—Griffiths & Seaton PLLC

(57) ABSTRACT

An accordion sign assembly includes a sign holder and an accordion sign. The sign holder has an elongate shape and an upper surface. The accordion sign includes a plurality of sections for displaying indicia, the sections defining a top edge, a bottom edge, and being interconnected at a plurality of pleats. The accordion sign also includes a plurality of tabs connected to the bottom edge of the plurality of sections at a plurality of fold lines that are substantially orthogonal to the plurality of sections. The plurality of tabs are folded relative to the plurality of sections to extend substantially orthogonally from the plurality of sections. A plurality of fasteners secures the plurality of tabs to the sign holder.

23 Claims, 8 Drawing Sheets

U.S. PATENT DOCUMENTS 6,644,484 B1 11/2003 Sardis
6,786,340 B2 * 9/2004 Ford et al. ..... 211/59.1
6,915,916 B2 7/2005 Martins
6,974,037 B2 * 12/2005 Haney ..... 211/26
7,007,814 B2 3/2006 Ploix
2003/0056697 A1 3/2003 Crown et al.
2005/0230338 A1 10/2005 Farinola et al.

* cited by examiner

MULTI-PANEL BILLBOARD ACCESSORY

BACKGROUND

Display fixtures are often used to support and display merchandise in a retail environment. Display fixtures that are eye-catching, fun, interesting, or otherwise visually effective help promote retail sales. While traditional, basic display fixtures accomplish these goals to some extent, enhancements in the functionality, or overall merchandising effect, of such display fixtures remain to be realized.

SUMMARY

Some embodiments relate to a display system including a fixture adapted to support merchandise in a retail environment. The fixture includes a first end piece and a second end piece positioned opposite the first end piece, the first and second end pieces being adapted to support the base fixture on a substantially horizontal surface. The fixture also includes an upper cross member extending substantially horizontally between the first and second end pieces. The system further includes a display accessory removably secured to the fixture. The display accessory includes a sign base defining a substantially flat upper surface and a display piece secured to the sign base, the display piece including a plurality of panels interconnected with one another, each panel being angularly offset relative to an adjacent panel.

Other embodiments relate to an accordion sign assembly including a sign holder and an accordion sign. The sign holder has an elongate shape and an upper surface. The accordion sign includes a plurality of sections for displaying indicia. The plurality of sections defines a top edge, a bottom edge, and are interconnected at a plurality of pleats. The accordion sign also includes a plurality of tabs connected to the bottom edge of the plurality of sections at a plurality of fold lines that are substantially orthogonal to the plurality of sections, the plurality of tabs being folded relative to the plurality of sections to extend substantially orthogonally from the plurality of sections. A plurality of fasteners secures the plurality of tabs to the sign holder such that the plurality of sections extend opposite the upper surface of the sign holder.

Still other embodiments relate to a method of assembling a merchandising system. The method includes forming a sign from a flat state into a folded state. The sign including a plurality of flanges each connected to a corresponding one of a plurality of frames at a plurality of fold lines, each frame defining a front face and being connected an adjacent frame at a pleat. Forming the sign from a flat state into a folded state includes folding the flanges toward the front faces of the corresponding frames such that the flanges are substantially orthogonal to the frames. The frames are folded toward one another into an accordion configuration. Additionally, the flanges are secured to a planar top surface of a support piece having an elongate shape using a plurality of fasteners.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 8 is an isometric view of the display system;

FIG. 9 is a front view thereof;

FIG. 10 is a back view thereof;

FIG. 11 is a right end view thereof with a left end view being substantially identical to the right end view;

FIG. 12 is a top view thereof; and

FIG. 13 is a bottom view thereof.

Figure 1:
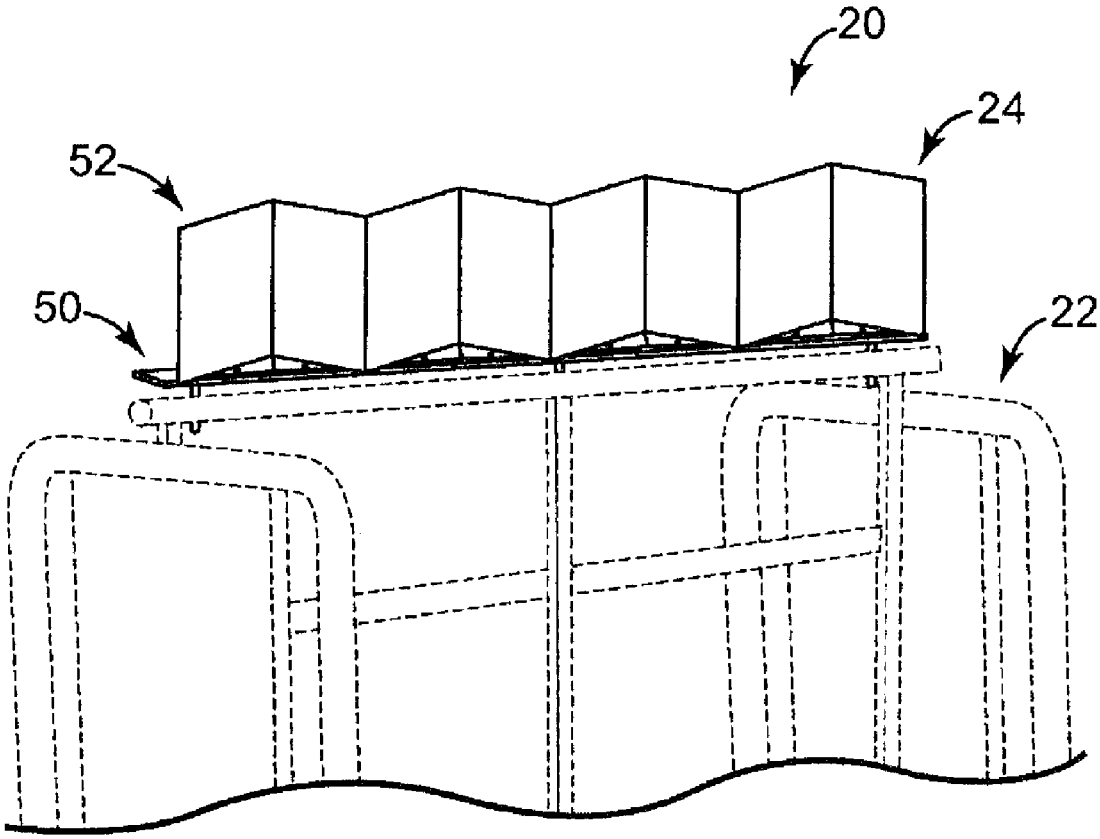
FIG. 1 is an isometric view of a display system, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 shows a display system 20, also described as a merchandising system or a merchandising display. Generally speaking, the display system 20 includes a fixture 22 (shown in dotted lines in FIG. 1 to assist in understanding) and a multi-panel display assembly 24.

The multi-panel display assembly 24 is an "accessory" of the fixture 22, which is optionally interchanged or used in combination with other "accessories," such as those described in copending patent application Ser. No. 11/627,262, filed Jan. 25, 2007, and entitled "DISPLAY FIXTURE ACCESSORIES," the contents of which are incorporated herein by reference. For example, the display system 20 is optionally used in a retail environment to merchandise soft-lines (clothing and the like), as well as hard-lines (non-clothing items such as CDs, DVDs, jewelry, sunglasses, and others).

Figure 2:
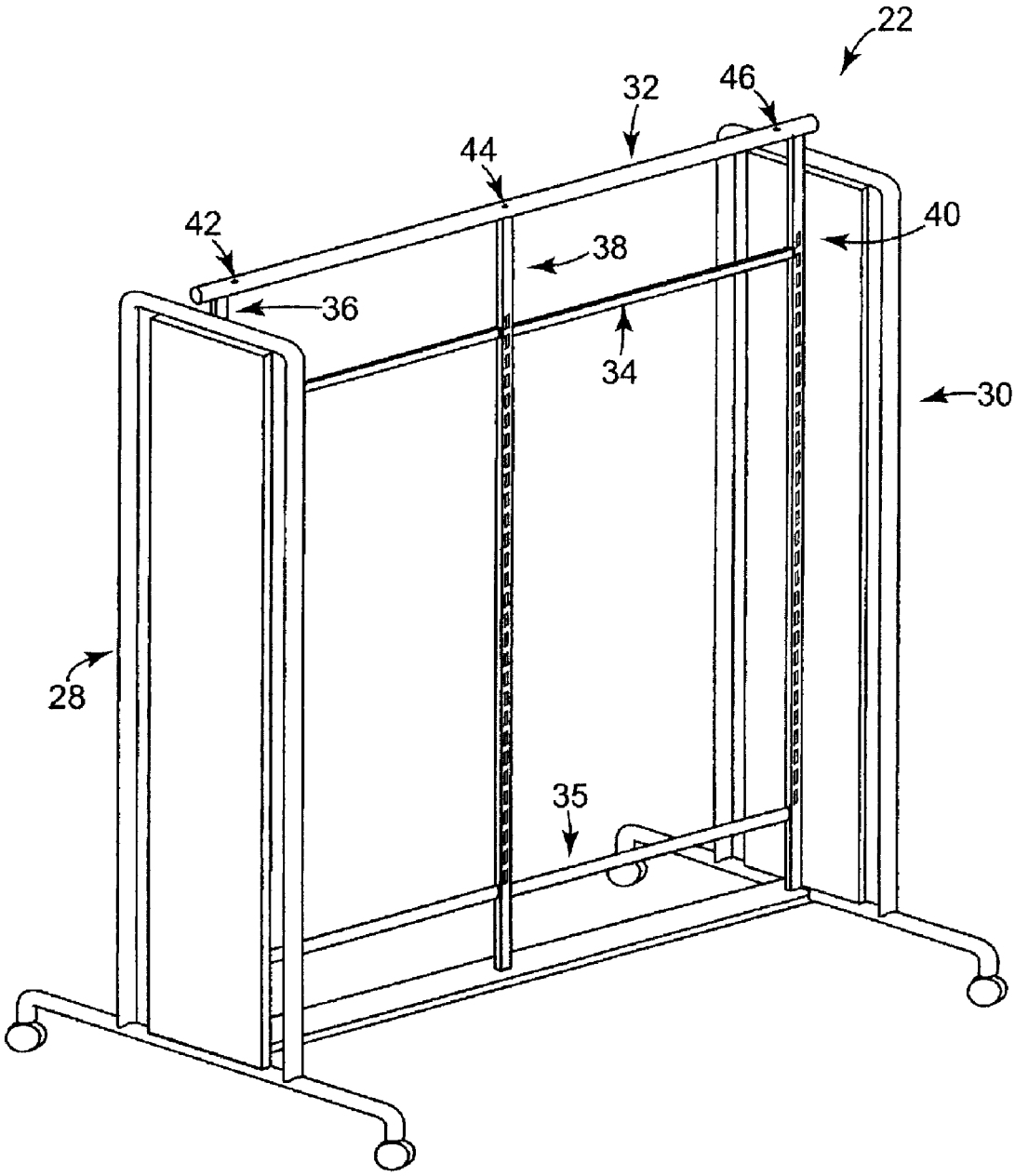
FIG. 2 is an isometric view of a fixture of the display system of FIG. 1, according to some embodiments.

The fixture 22 is also described as a convertible fixture, a base fixture, or a display fixture. FIG. 2 is an isometric view of the fixture 22. The fixture 22 includes a first end piece 28, a second end piece 30, an upper member 32, an intermediate member 34, a lower member 35, a first outer member 36, a central member 38, and a second outer member 40. The first outer member 36 is partially obscured in FIG. 2, but is substantially similar to the second outer member 40 according to various embodiments. The upper, intermediate, and lower members 34, 35, 36 are also described as cross members or lateral bars. The first and second end pieces 28, 30 are opposingly positioned, on opposite ends of the convertible fixture 22, and are adapted to support the convertible fixture 22 on a substantially horizontal surface (not shown).

The upper member 32, the lower member 35, the first outer member 36, the central member 38, and the second outer member 40 are each optionally substantially hollow and tubular in shape, for example having substantially round or square transverse cross-sections as desired, although other cross-sections are also contemplated. The intermediate member 34 is substantially rectangular in transverse cross-section, and is otherwise described as an elongate band, or strip of material, although other shapes for the intermediate member 34 are contemplated, such as a substantially round shape, for example.

The upper, intermediate, and lower members 32, 34, 35 extend horizontally between the end pieces 28, 30, defining a substantially horizontal span between the end pieces 28, 30. The upper member 32 has a first locator hole 42, a central locator hole 44, and a second locator hole 46 extending through the tubular shape of the upper member 32. In some embodiments, each of the locator holes 42, 44, 46 is formed as a round or square opening in the top of the upper member 32 and a substantially square opening 48 (FIG. 6) in the bottom of the upper member 32. The first and second outer members 36, 40 and the central member 38 each has a plurality of square attachment slots adapted to receive projections for releasably securing hangers, hooks, shelves, or other display means (not shown) to the convertible fixture 22 as desired.

Figure 5:
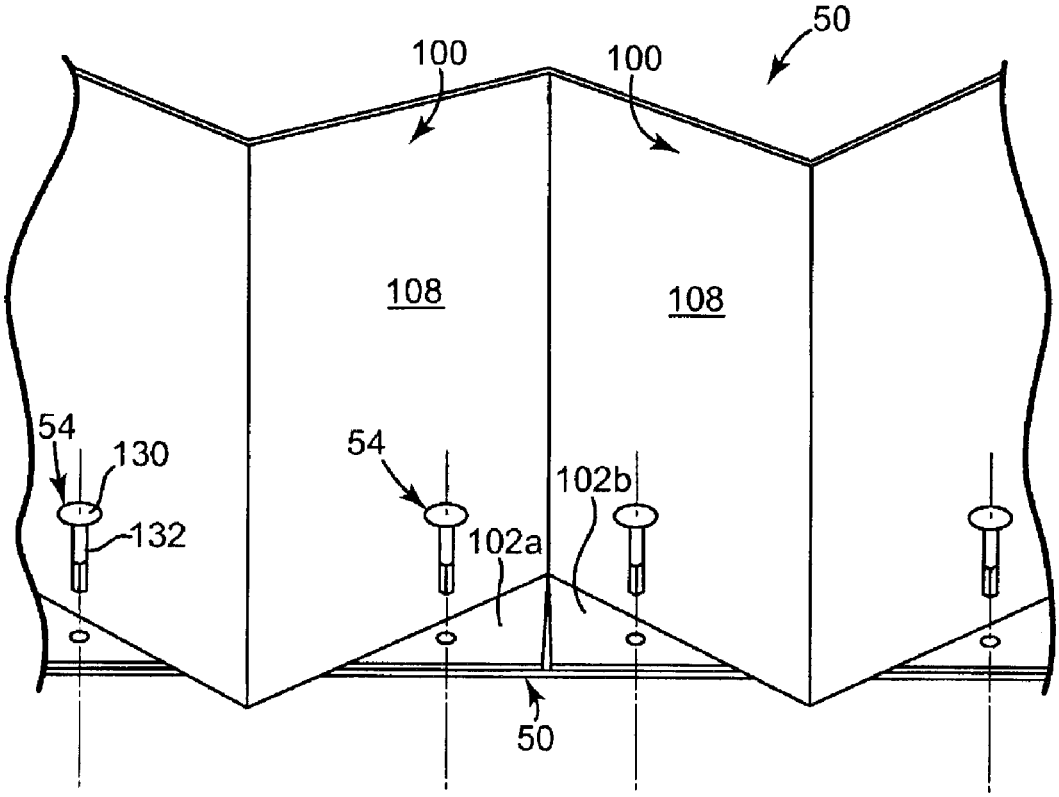
FIG. 5 is an isometric view of a multi-panel sign assembly of the display system of FIG. 1 with the assembly in a partially assembled state and the sign in a folded state, according to some embodiments.

As shown in FIG. 1, the display accessory 24, also described as an accordion sign assembly or retail fixture accessory, includes a sign holder 50 and an accordion sign 52 releasably maintained by, or otherwise releasably secured to the sign holder 50 with a plurality of fasteners 54 (FIG. 5).

Figures 3A, 3B:
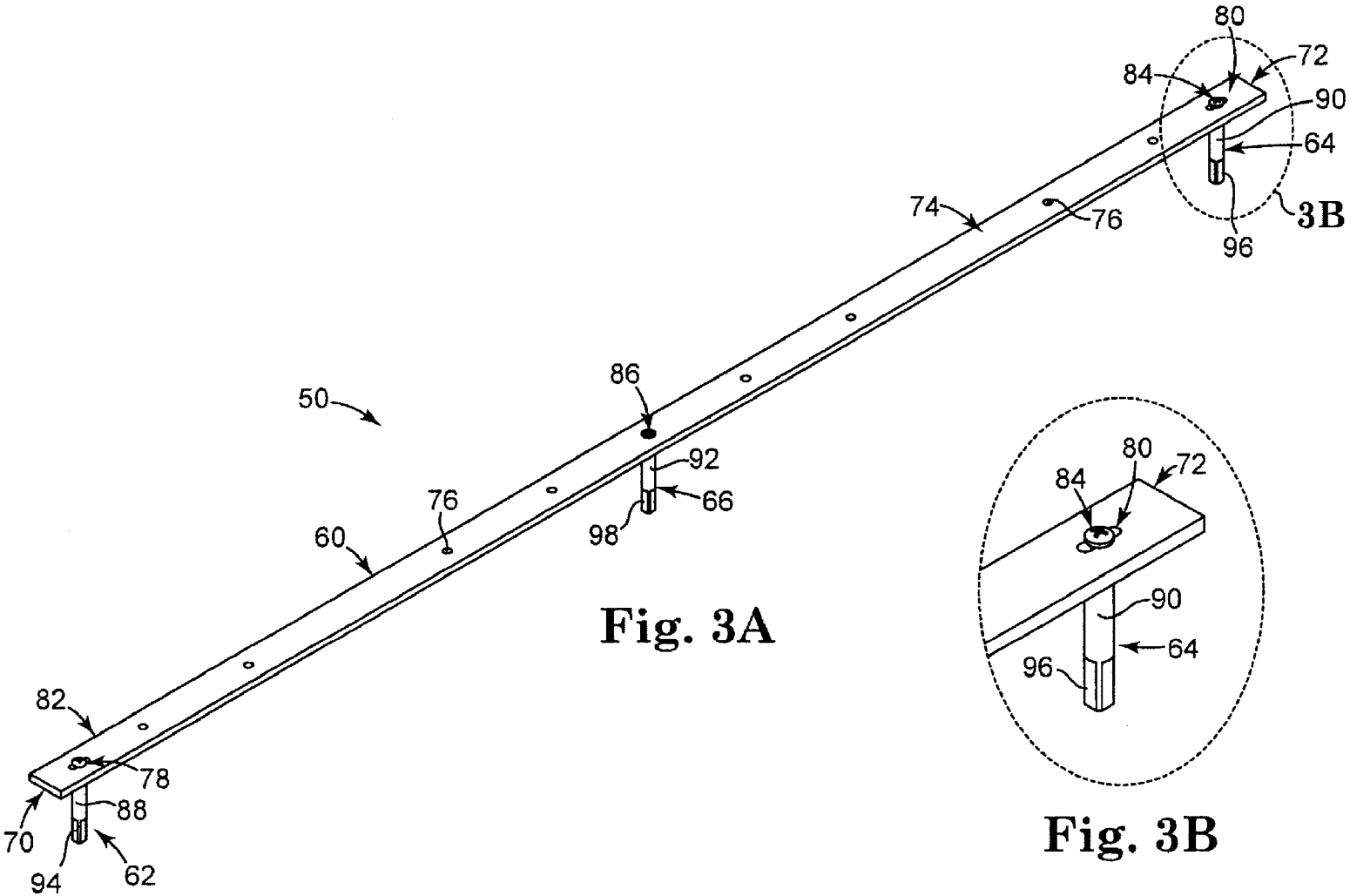
FIG. 3A is an isometric view of a sign holder of the display system of FIG. 1, according to some embodiments.
FIG. 3B is an enlarged view of a portion of the sign holder of FIG. 3A, according to some embodiments.

The sign holder 50, also described as a sign base or support piece, is shown in greater detail in FIGS. 3A and 3B. As shown in FIGS. 3A and 3B, the sign holder 50 includes a body 60, a first post 62, a second post 64, and a central post 66 between the first and second posts 62, 64.

The body 60 is substantially thin, and elongate in shape and defines a substantially rectangular transverse cross-section, according to some embodiments. The body 60 extends from a first end 70 to a second end 72 and defines a substantially flat, or planar, upper surface 74. The body 60 includes a plurality of holes 76 along the body 60, as well as a first slot 78 and a second slot 80 positioned toward, or otherwise proximate to the first and second ends 70, 72.

The first and second posts 62, 64 are secured within the first and second slots 78, 80, respectively. The first and second slots 78, 80, are also described as channels or slide holes. For example, the first, second, and central posts 62, 64, 66 optionally include screw heads 82, 84, 86 which can be used to rotate the posts 62, 64, 66 within the slots.

The posts 62, 64, 66, also described as supports or projections, each include upper, cylindrical portions 88, 90, 92 and lower, squared portions 94, 96, 98, respectively. The first and second posts 62, 64 are secured to the body 60 through the slots 78, 80 such that the posts 62, 64 can be adjusted laterally within a desired range of movement. The central post 66 is optionally substantially similar to the first and second posts 62, 64, but is secured to the body 60 through a hole (not shown) through the body 60 which helps prevent substantial lateral movement of the central post 66. In particular, the central post 66 is optionally laterally fixed to help prevent the sign holder 50 from shifting laterally when assembled to the fixture 22, as described in greater detail below, although embodiments including a laterally adjustable central post 66 are contemplated.

Figure 4:
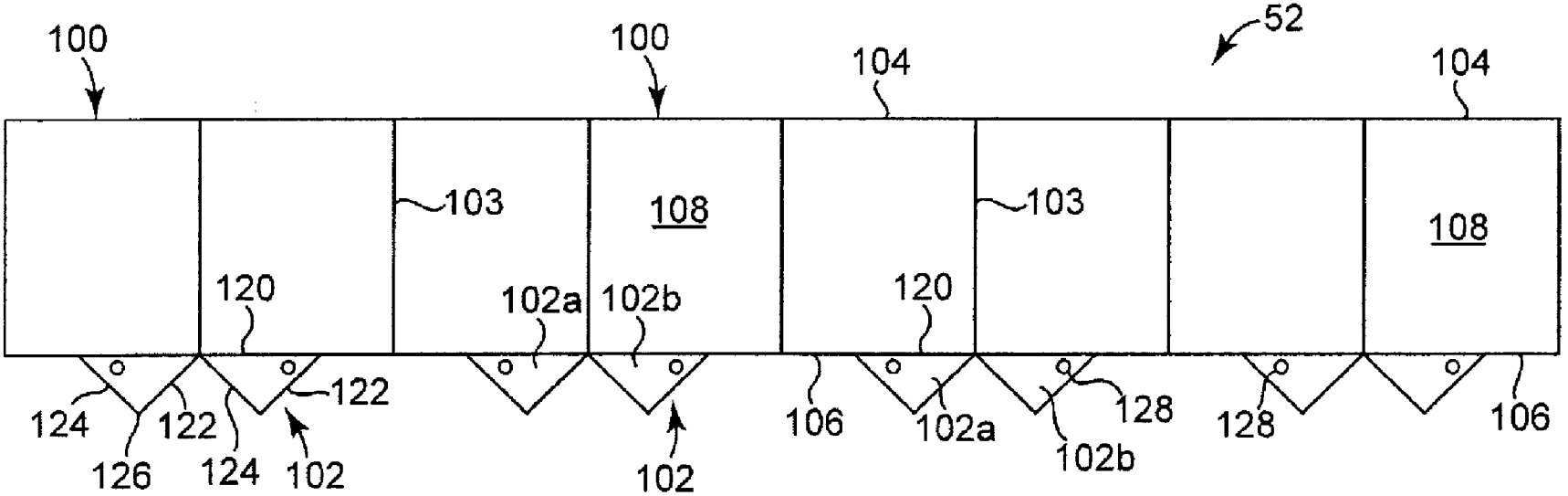
FIG. 4 is a front view of a sign of the display system of FIG. 1 in a flat state, according to some embodiments.

FIG. 4 shows the accordion sign 52, also described as a display piece or multi-panel sign, in greater detail. The accordion sign 52 is formed of a plurality of panels 100 and a plurality of tabs 102 extending from the panels 100. Although eight panels are shown in FIG. 4, any number of panels are contemplated. Some or all of the panels 100, also described as sections or frames, have indicia, such as designs, words, or other images as desired. The panels 100 are secured side-to-side, with adjacent panels 100 being hinged, or foldably connected at pleats 103, also described as score lines or fold lines. In particular, the panels 100 are interconnected edgewise along the pleats 103 such that the sign 52 can be transitioned from a flat state as shown in FIG. 4 to a folded state, or pleated state as shown in FIG. 1, for example.

Figure 7:
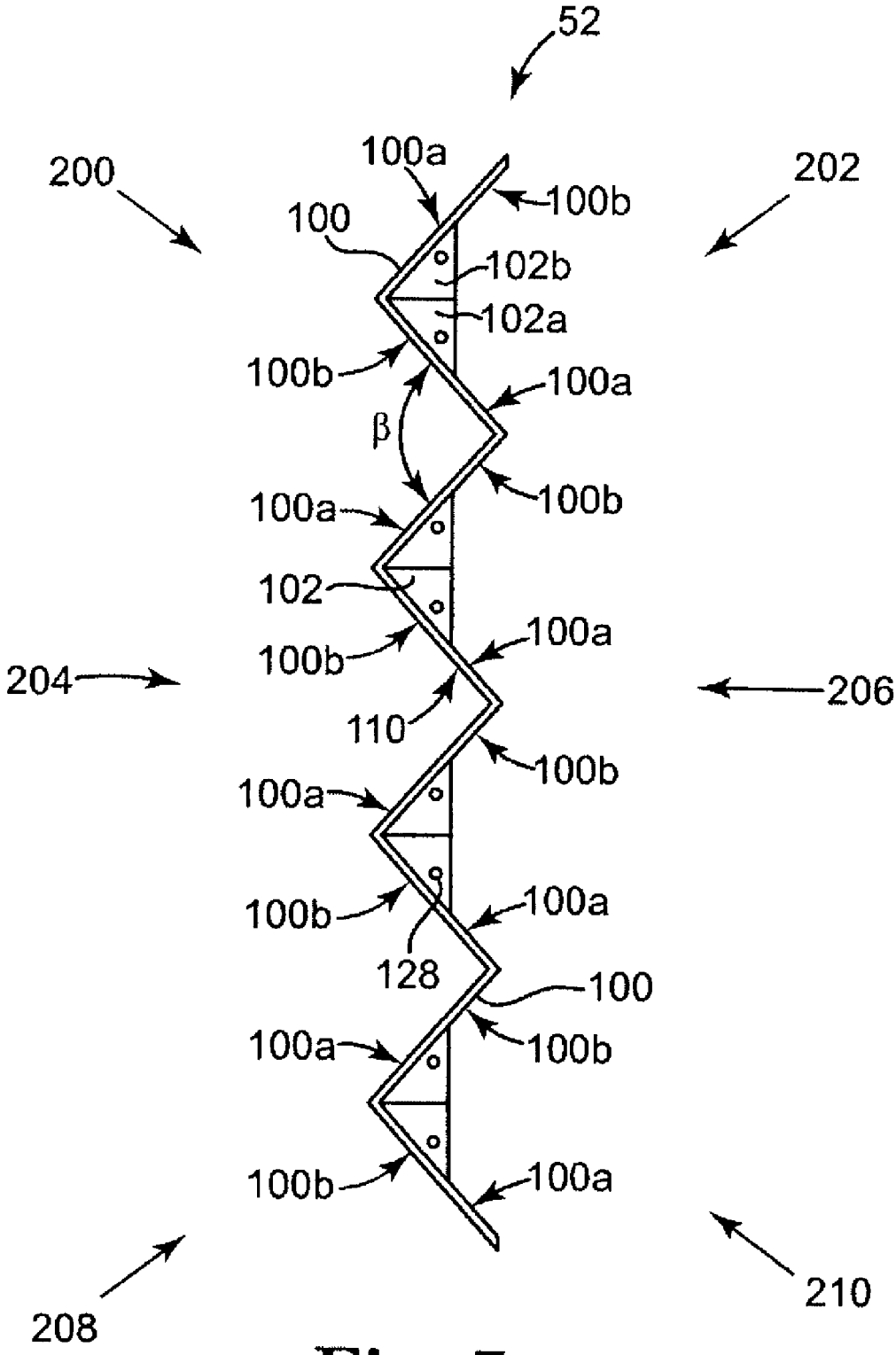
FIG. 7 is a top view of the sign of the display system of FIG. 1 showing various viewing angles of the sign, according to some embodiments.
Figure 8:
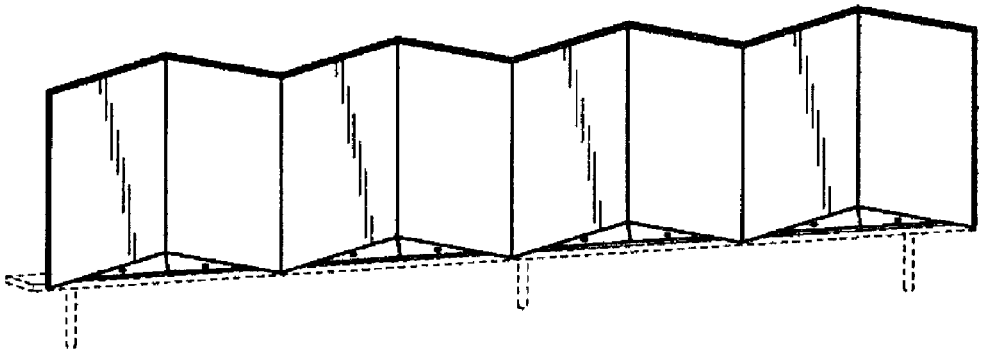
FIGS. 8-13 are additional illustrations of a display system, according to some embodiments, where
Figure 9:
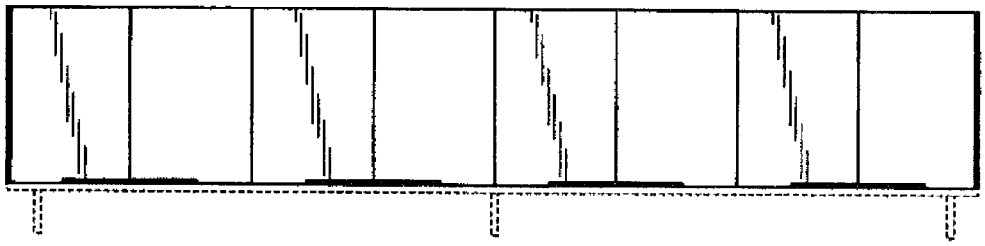
Figure 10:
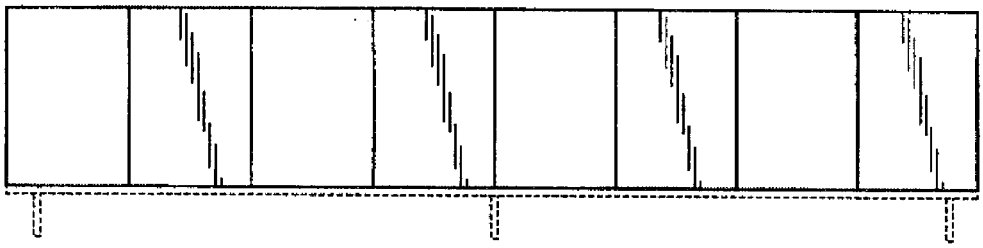
Figure 11:
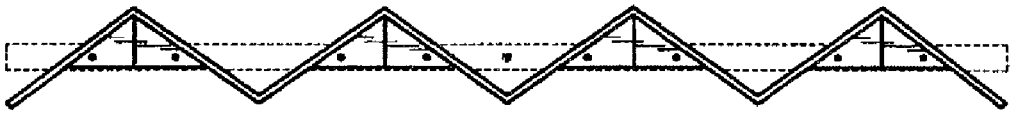
Figure 12:
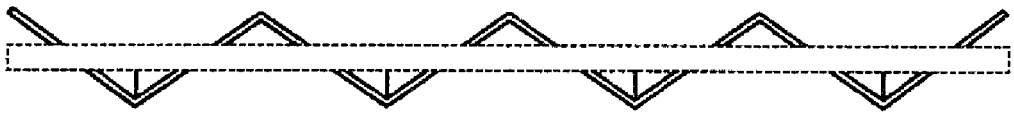
Figure 13:
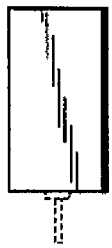

The panels 100 each have a top edge 104 that is a free edge, a bottom edge 106, a front face 108, and a back face 110 (FIG. 7). As will be described in greater detail, the panels 100 are optionally folded or pleated to the folded state shown in FIG. 1 to provide an accordion style presentation of indicia printed or otherwise included with the panels 100.

The tabs 102, also described as flanges, are connected to the bottom edges 106 of the panels 100 at a plurality of fold lines 120, which are substantially orthogonal in orientation to the pleats 103. For reference, the tabs 102 and panels 100 are optionally formed of a single piece or sheet of material, such as a wood fiber or plastic material, with the individual panels 100 and tabs 102 being defined by introducing score lines in the material. As shown, the tabs 102 define tab pairs 102*a*, 102*b* that are offset toward one another along the bottom edges 106 of the panels.

Each of the tabs 102 is substantially triangular in shape, and separate from adjacent tabs 102. Each tab 102 defines a first free edge 122 and a second free edge 124 that meet at a distal end 126. The tabs 102 also each define a through hole 128. Although substantially triangular-shaped tabs are shown, a variety of shapes, such as semi-circular, for example, are also contemplated. The tabs 102 are adapted to be folded upward toward the front faces 108 of the panels 100 from the flat state shown in FIG. 4 to the folded state shown in FIG. 1 such that the tabs 102 are substantially orthogonal to the panels 100. The panels 100 can then be folded toward one another, or pleated accordion-style such that first and second edges 122, 124 of adjacent tabs 102 are substantially abutted against one another. As shown in FIG. 4, the edges of adjacent ones of the tabs 120 need not abut along an entirety thereof, but are optionally abutted along a portion of the respective edges.

The plurality of fasteners 54 are shown generally in FIG. 5 and can take a variety of forms. Suitable fastener examples include those sold under the name, "CANOE CLIPS," available from ITW Fastex of Des Plaines, Ill., for example. In some embodiments the plurality of fasteners 54 each include a head 130 and a collapsible body 132. For reference, the sign 52 is optionally secured to the sign holder 50 prior to, after, or concurrently with securing the sign holder 50 to the fixture 22.

In some embodiments, assembling the system 20 (FIG. 1) includes assembling the multi-panel assembly 24 as shown in FIG. 5 by transitioning or forming the sign 52 from the flat state (FIG. 4) into the folded state. The sign 52 is transitioned to the folded state by folding the tab pairs 102*a*, 102*b* toward the front faces 108 of the corresponding panels 100 such that the tabs 102 are substantially orthogonal to the panels 100. In turn, the panels 100 are folded toward one another into an accordion configuration by pleating the sign 52 along the pleat lines 103.

Using the plurality of fasteners 54, the sign 52 is successively attached, or fastened, to the sign holder 50 (partially obscured by the sign 52 in FIG. 5). In some embodiments, an assembler (not shown), such as a store employee, attaches one of the fasteners 54 at each end of the sign 52, working toward the middle of the sign 52 and sign holder 50, inserting fasteners 54 along the way. In particular, the triangle-shaped tab pairs 102*a*, 102*b* are bent along the fold lines 120 and once the panels 100 are pleated, the edges 122, 124 of the adjacent tabs 102*a*, 102*b* are abutted such that the through holes 128 in the tabs 102*a*, 102*b* line up with the corresponding holes 76 (FIG. 3A) in the sign holder 50.

As shown in FIG. 5, with the panels 100 pleated from the flat state into the accordion-style configuration, the tab pairs 102*a*, 102*b* are abutted, edge-to-edge against one another to define a larger, triangular shape between corresponding, adjacent panels 100. Furthermore, in addition to the through holes of each of the tab pairs 102*a*, 102*b* being aligned, the through holes 128 in all of the tabs 102 are optionally substantially aligned with one another in a row when the sign 52 is in the folded state, as generally shown in FIG. 7.

As alluded to above, the fasteners 54 are pushed through the through holes 128 in the sign 52 and the holes 76 in the sign holder 50 to secure the sign 52 to the sign holder 50 such that the sign 52 extends opposite from the upper surface 74 of the sign holder 50. In some embodiments, the sign 52 can be readily released from the sign holder 50 by pulling out the fasteners 54.

After, before, or as the tabs 102 are being releasably secured to the top surface of the sign holder 50 with the plurality of fasteners 54 the sign holder 50 is releasably secured to the fixture 22 as shown in FIG. 1. For reference, each of the first and second locator holes 42, 46 (FIG. 2) vary by fixture type and/or model, for example. As such, releasably securing the sign holder 50 to the fixture 22 includes laterally adjusting one or both of the first and second posts 62, 64 (FIG. 3A) to correspond to a position of the first and second locator holes 42, 46 in the fixture 22. In particular, the posts 62, 64 are slid within the slots 78, 80 (FIG. 3A) to a desired lateral position.

Figure 6:
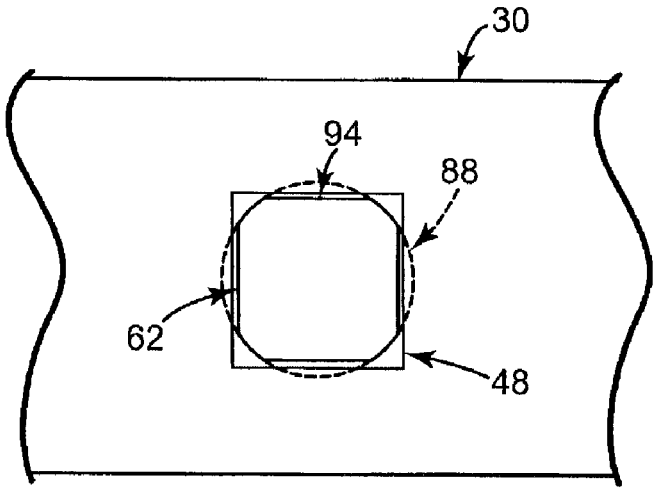
FIG. 6 is a bottom view of a portion of the display system of FIG. 1, according to some embodiments.

With the posts 62, 64 positioned as desired, the squared portions 94, 96, 98 (FIG. 3A) of the posts 62, 64, 66 are inserted through both the upper openings (FIG. 1) and lower square openings 48 (FIG. 6). The squared portions 94, 96, 98 are optionally aligned to the square openings 48 in the bottom of the upper member 32 by rotating the posts 62, 64, 66 using the screw heads 82, 84, 86 (FIG. 3A).

To facilitate understanding, FIG. 6 shows a bottom view of a portion of the upper member 32 with the first post 62 inserted through the first locator hole 42. FIG. 6 shows the square opening 48 corresponding to the first locator hole 42, the squared portion 94 of the first post 62, and the round portion 88 of the first post (in dotted lines in FIG. 6). As shown in FIG. 6, once each of the squared portions 94, 96, 98 are rotationally aligned to the square openings 48 in the bottom of the upper member 32, the squared portions 94, 96, 98 drop through the bottom square openings 48. The posts 62, 64, 66 continue downward until the round portions 88, 90, 92 reach the square openings 48 at which point further insertion of the posts into the locator holes 42, 44, 46 is arrested. In other words, the round portions 88, 90, 92 in combination with the square openings 48, act as a stop or otherwise limit further downward insertion of the posts 62, 64, 66 into the locator holes 42, 44, 46.

FIG. 7 shows the sign 52 in a folded state and from a top view with various angles of observation 200, 202, 204, 206, 208, and 210 designated by arrows. In FIG. 7, the sign 52 is adapted to present alternating indicia 100*a*, 100*b*, on the panels 100. For example, 100*a* optionally corresponds to a first image while 100*b* optionally corresponds to a second image, although any number of images/patterns of alternating indicia are contemplated.

When viewed from the angles of observation 200, 202, for example, the observer is presented with a visual effect dominated by indicia 100*a*. When viewed from the angles of observation 204, 206, the observer is presented with a visual effect including both indicia 100*a*, 100*b*. When viewed from angles of observation 208, 210, the observer is presented with a visual effect dominated by indicia 100*b*. Thus, as the observer walks toward and past the sign 52, an undulating, or pseudo-lenticular effect is produced, with the visual effect presented to the user changing from the first indicia 100*a*, to both indicia 100*a*, 100*b*, to the second indicia 100*b*. The visual effect can be adjusted by increasing the number of different types of indicia, as well as by modifying the sign 52 to vary the angle β between adjacent panels 100.

The fixture 22 is optionally placed on a floor in a retail environment or other display environment as desired. The multi-panel display assembly 24 is then optionally used to serve as a means for releasably and adjustably securing the multi-panel display assembly 24 to the retail fixture 22, and for displaying indicia to an observer in an accordion style presentation. As previously referenced, the indicia on the panels 100 is optionally varied from panel-to-panel to generate a pseudo-lenticular, or undulating effect for merchandising retail items in the retail environment or in other applications as desired (e.g., for displaying safety information, directions, or other types of information).

In the detailed description, reference has been made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the embodiment display systems can be positioned in a number of different orientations, the directional terminology is used for the purposes of illustration and is not intended to be read in a restrictive manner.

From the above, it should be understood that some embodiments of the invention provide eye-catching, fun, interesting, or otherwise visually effective displays. Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

The invention claimed is:

1. A display system comprising:

a fixture adapted to support merchandise in a retail environment, the fixture including:

a first end piece and a second end piece positioned opposite the first end piece, the first and second end pieces being adapted to support the base fixture on a substantially horizontal surface, an upper cross member extending substantially horizontally between the first and second end pieces; and a display accessory removably secured to the fixture, the display accessory comprising:

a sign base defining a substantially flat upper surface; and a display piece secured to the sign base, the display piece including:

a plurality of panels interconnected with one another, each panel defining a top edge and a bottom edge, the plurality of panels being angularly offset relative to an adjacent panel; and a plurality of tabs connected to the bottom edges of the plurality of panels at a plurality of fold lines that are substantially orthogonal to the plurality of panels, the plurality of tabs defining adjacent tab pairs that are offset toward one another along the bottom edges of the panels and the plurality of tabs being folded relative to the plurality of panels to extend substantially orthogonally from the plurality of panels such that the adjacent tab pairs substantially abut one another;

wherein the upper cross member defines a top surface having a plurality of openings, wherein the sign base is a substantially elongate bar including a plurality of supports extending opposite the substantially planar upper surface, and further wherein the plurality of supports are inserted into the plurality of openings of the upper cross member to releasably secure the sign base to the upper cross member.

2. The display system of claim 1, wherein the plurality of supports includes a first support, a second support, and a central support located between the first and second supports, and further wherein at least one of the first and second supports is laterally adjustable relative to the sign base.

3. The display system of claim 2, wherein the sign base has a first slot and a second slot positioned toward each end of the sign base, and further wherein the first and second supports are received in and able to be laterally adjusted in the first and second slots, respectively.

4. The display system of claim 1, wherein the base and the display piece of the display accessory are substantially similar in overall length to the upper cross member of the fixture.

5. The display system of claim 1, wherein:

the display piece defines a plurality of pleat lines each defined between two adjacent ones of the plurality of panels, each of the plurality of pleat lines extends parallel to the other of the plurality of pleat lines, and the plurality of panels are folded in alternating directions along successive ones of the plurality of pleat lines such that every other one of the plurality of panels extends parallel to each other.

6. The display system of claim 5, wherein:

each the plurality of pleat lines is spaced from the sign base, and successive ones of the plurality of pleat lines are positioned on alternating sides of the sign base.

7. The display system of claim 1, wherein each of the plurality of tabs is separately coupled to the sign base with a different one of a plurality of fasteners.

8. An accordion sign assembly comprising:

a sign holder having an elongate shape and an upper surface;

an accordion sign including:

a plurality of sections for displaying indicia, the plurality of sections defining a top edge, a bottom edge, and being interconnected at a plurality of pleats, wherein the plurality of sections are folded in alternating directions about successive ones of the plurality of pleats, and a plurality of tabs connected to the bottom edge of the plurality of sections at a plurality of fold lines that are substantially orthogonal to the plurality of sections, the plurality of tabs being folded relative to the plurality of sections to extend substantially orthogonally from the plurality of sections; and a plurality of fasteners securing the plurality of tabs to the sign holder such that the plurality of sections extend opposite the upper surface of the sign holder;

wherein at least two of the plurality of tabs define an adjacent tab pair, each of the tabs of the adjacent tab pair defining a free edge, the free edges being substantially abutted edgewise with one another.

9. The accordion sign assembly of claim 8, wherein each of the plurality of tabs is substantially triangular in shape.

10. The accordion sign assembly of claim 9, wherein each of the plurality of tabs is abutted edgewise with an adjacent one of the plurality of tabs.

11. The accordion sign assembly of claim 8, wherein each of the plurality of tabs has a through hole for receiving one of the plurality of fasteners, and each of the plurality of tabs is secured to the sign holder by a different one of the plurality of fasteners.

12. The accordion sign assembly of claim 8, wherein each of the plurality of tabs is formed separate from an adjacent tab.

13. The accordion sign assembly of claim 8, wherein the accordion sign is formed of a paper material.

14. The accordion sign assembly of claim 8, wherein the sign holder includes a plurality of elongate projections extending opposite the upper surface.

15. The accordion sign assembly of claim 14, wherein the plurality of elongate projections includes a first projection toward one end of the sign holder, a second projection toward an opposite end of the sign holder, and a central projection between the first and second projections, and further wherein at least one of the first and second projections is laterally adjustable.

16. The accordion sign assembly of claim 15, wherein the sign holder has at least one elongated channel for laterally adjustably receiving at least one of the first and second projections.

17. The accordion sign assembly of claim 8, wherein:

each one of the plurality of pleats linearly extends parallel to the other ones of the plurality of pleats, and the plurality of sections are arranged such that successive ones of the plurality of sections extend in alternating directions and alternating ones of the plurality of sections extend parallel to one another.

18. The accordion sign assembly of claim 8, wherein:

each of the plurality of pleats is spaced from the sign holder, and successive ones of the plurality of pleats are positioned on alternating sides of the sign holder.

19. A method of assembling a merchandising system, the method comprising:

forming a sign from a flat state into a folded state, the sign including a plurality of flanges each connected to a bottom edge of a corresponding one of a plurality of frames at a plurality of fold lines, the plurality of flanges defining adjacent flange pairs that are offset toward one another along the bottom edges of the frames and each frame defining a front face and being connected to an adjacent frame at a pleat, wherein forming the sign from the flat state into the folded state includes:

folding the flanges toward the front faces of the corresponding frames such that the flanges are substantially orthogonal to the frames;

folding the frames toward one another into an accordion configuration such that adjacent pairs of flanges substantially abut one another, wherein folding the frames in the accordion configuration includes folding the frames toward one another in alternating directions about successive ones of the plurality of fold lines; and securing the flanges to a planar top surface of a support piece having an elongate shape using a plurality of fasteners;

wherein successive ones of the plurality of frames extend in alternating directions, and alternating ones of the plurality of frames extend parallel to one another.

20. The method of claim 19, further comprising:

releasably securing the support piece to a base fixture including a first end piece supported on a floor, a second end piece supported on the floor, and an upper cross member extending substantially horizontally between the first and second end pieces.

21. The method of claim 20, wherein releasably securing the support piece to the base fixture includes inserting a plurality of posts of the support piece into a corresponding set of holes in the upper cross member.

22. The method of claim 21, wherein at least one of the plurality of posts is laterally adjustable, and further wherein releasably securing the support piece to the base fixture includes laterally adjusting the at least one post to align the at least one laterally adjustable post to one of the corresponding set of holes in the upper cross member.

23. The method of claim 20, further comprising:

placing a base fixture on the floor in a retail environment, the base fixture including a first end piece supported on the floor, a second end piece supported on the floor, and a cross member extending between the first and second end pieces.

* * * * *